US005820704A

United States Patent [19]

Veyer et al.

[11] Patent Number: 5,820,704

[45] Date of Patent: Oct. 13, 1998

[54] PROCESS FOR THE CONTINUOUS PRODUCTION OF A ROLLED STAINLESS STEEL SHEET STRIP AND CONTINUOUS PRODUCTION LINE FOR CARRYING OUT THE PROCESS

[75] Inventors: Jean Veyer, Molinghem; Jean-Pierre Malingriaux, Norrent-Fontes; Michel Ternisien, Busnes; Henri Giraud, Gueugnon; Joël Tagalian, Paray le Monial; Bernard Vialatte, Le Creusot; Bernard Têtu, Saint-Vital, all of France

[73] Assignee: Usinor Sacilor, Puteaux, France

[21] Appl. No.: 733,872

[22] Filed: Oct. 18, 1996

[30] Foreign Application Priority Data

Oct. 19, 1995 [FR] France ..... 95 12271

[51] Int. Cl.[6] ..... C21D 8/02

[52] U.S. Cl. ..... 148/610; 266/115; 266/103

[58] Field of Search ..... 148/610; 266/115, 266/103, 108, 109, 110, 111, 112, 113

[56] References Cited

U.S. PATENT DOCUMENTS 4,550,487 11/1985 Hoshino et al. ..... 148/610

5,554,235 9/1996 Noe et al. ..... 148/610

FOREIGN PATENT DOCUMENTS 62-253732 11/1987 Japan ..... 148/610

*Primary Examiner*—Deborah Yee

*Attorney, Agent, or Firm*—Oblon, Spivak, McClelland, Maier & Neustadt, P.C.

[57] ABSTRACT

Process for continuously producing on a production line a rolled stainless steel sheet product having an improved surface state, characterized in that the hot produced sheet is subjected to a treatment comprising at least:

a primary pickling for removing scale, cold rolling in at the most three rolling passes, a final annealing, a final pickling, and a cold rolling of the "skin pass" type.

There is optionally effected, before the primary pickling, a stretcher levelling which produces a residual elongation of 1 to 5% for cracking the layer of oxide and rendering the sheet planar. Apparatus for carrying out the invention process is also described.

38 Claims, 4 Drawing Sheets

PROCESS FOR THE CONTINUOUS PRODUCTION OF A ROLLED STAINLESS STEEL SHEET STRIP AND CONTINUOUS PRODUCTION LINE FOR CARRYING OUT THE PROCESS

BACKGROUND OF THE INVENTION

1. Field of the Invention

The present invention relates to a process for continuously producing a rolled stainless steel product, preferably a sheet strip, having an improved surface. An apparatus for carrying out the invention process is also described, and makes up part of the invention.

2. Discussion of the Background

Various processes are known for producing a stainless steel sheet strip from a hot rolled sheet strip, which processes obtain a sheet having an improved surface state characterized, for example, by a roughness Ra lower than 0.25 micrometer.

For example, a process is known for producing a stainless steel sheet strip comprising operations for annealing the hot rolled sheet strip, and pickling said strip, said operations being carried out on a first production line. On a second line, the pickled sheet strip is subjected to a cold rolling operation on a reversing mill, the rolling operation being effected in at least five passes, and generally in seven or more passes, with a reduction which may vary between 50 and 80%. Cold rolled in this way, the sheet strip is then put into a coil and conveyed on a line to undergo an annealing followed by a pickling. Lastly, the pickled sheet strip is subjected to a cold rolling operation of the skin pass-type which may be followed by a levelling and a shearing operation.

The drawback of this process is due in particular to the large number of plants in which the hot rolled strip of sheet must be treated in succession with, consequently, the costs of the treatment, the maintenance and the personnel, many intermediate handlings with risks of damage to the sheet strip, losses of metal due to rejection, and treatment durations generally longer than one week and even two weeks or more due to the waiting periods before each of the plants, which waiting periods require corresponding stocks, stocking areas and stocking costs.

OBJECTS OF THE INVENTION

One object of the present invention is to overcome the drawbacks of the prior art and to provide a method for the continuous production of a stainless steel product such as a sheet strip having on the surface given characteristics of roughness and homogeneity of appearance, the product being obtained on a single production line, the production process ensuring a considerable reduction in the number of passes in the cold rolling operation and permitting the carrying out, economically, of all of the operations required to obtain a product, particularly a sheet strip, having a predefined surface quality.

Another object of the present invention is to provide an apparatus capable of carrying out the above-described invention method.

SUMMARY OF THE INVENTION

The invention therefore provides a process for the continuous production on a production line of a rolled stainless steel product such as a sheet strip, the product having an improved surface state. This process is characterized in that a hot produced product (sheet) is subjected to a treatment comprising at least:

primary pickling for removing scale, cold rolling in at the most three rolling passes, final annealing, final pickling, and cold rolling of the skin pass type.

Preferably, the invention method further comprises, before primary pickling, a stretcher levelling step producing a residual elongation of 1 to 5% (for cracking the oxide layer and rendering the sheet planar).

Other features of the invention include, individually and in any combination:

- the product (sheet strip) is subjected to abrasion which may be carried out before, and/or after, and/or during the primary pickling operation, the abrasion being preferably obtained with at least one brush;
- the sheet strip is, after the stretcher levelling step, subjected to a shot blasting for removing scale;
- for a ferritic steel product (strip), the cold rolling of the strip is carried out with a reduction lower than 60%;
- for an austenitic product (steel sheet strip), the cold rolling is carried out with a reduction lower than 50%;
- the product (sheet strip) is subjected to final annealing carried out in an oxidizing atmosphere at a temperature between 800° and 1200° C.;
- the sheet strip, after cold rolling and final annealing, is subjected to a cold rolling of the skin pass type, the cold rolling producing an elongation of the product (strip) of between 0.5 and 2%;
- the product (sheet strip) is, after the final pickling and the rolling of the skin pass type, further subjected to a levelling step;
- the product (sheet strip) is further subjected to a shearing operation for trimming the edges.

The invention also relates to a production line for producing a stainless steel product (sheet strip) by the process according to the invention, characterized in that it comprises, in succession,:

an optional stretcher leveller, a primary pickling station, a non-reversing continuous cold rolling device, an annealing device, a final pickling device, a cold rolling device of the skin pass type.

Further preferred features of the line include, alone or in any combination:

- the line further comprises a shot blasting station;
- the primary pickling station comprises means for ensuring a stoppage on the line of the pickling of the product (sheet strip);
- the pickling station comprises a tank containing an acid bath provided with a device for extracting from the bath the product (sheet strip) immersed in the latter;
- the pickling station is of the spraying type;
- the pickling station is electrolytic;
- the tank of the electrolytic pickling station contains an electrolyte selected from a neutral salt (e.g., sodium sulfate), a phosphoric acid, or a mixture thereof;
- the line further comprises abrasion means which may be placed before and/or after the pickling station and/or in the primary pickling station;
- the abrasion means is a brush;
- the cold rolling device comprises at the most three stands of the multiroll type, the working rolls having a diameter of less than 180 mm and preferably less than 150 mm;

the line further comprises at least one levelling station associated with the cold rolling device of the skin pass type;

the line further comprises at least one device for shearing the edge portions of the strip.

BRIEF DESCRIPTION OF THE DRAWINGS

The following detailed description and accompanying drawings, which are given merely by way of non-limitative examples, will further explain the invention.

In the drawings.

DESCRIPTION OF THE PREFERRED EMBODIMENTS

One preferred embodiment of the present invention relates to a process for the continuous production, on a production line, of a rolled stainless steel sheet strip having an improved surface state, characterized by a roughness Ra lower than 0.25 micrometer, and preferably lower than 0.15 micrometer, including lower than 0.1 micrometer, in the direction of length and in the direction of width, the process producing no change in the apparent color, no halo and no trace of oxide.

According to the preferred process of the invention, a hot rolled product (preferably a sheet strip) is subjected, first of all, to an optional but preferred stretcher levelling. The stretcher levelling has for its purpose to cause, by the stretching which produces a residue elongation of 1 to 5% of the sheet strip (the preferred steel strip will be referred to in this preferred embodiment, remembering that other products are available), a cracking of the layer of oxide on said strip. The stretcher levelling brings about, at this stage of the process, an improvement in the flatness of the sheet strip which has an influence on following operations, such as the shot blasting. After the stretcher levelling operation, the sheet strip is subjected to a pickling which ensures an improved surface state of the sheet strip as compared with a conventional method for producing a sheet strip, as described in the prior art referred to hereinbefore. The general width of the strip is not particularly limited but typically ranges from 700 mm to 1600 mm. Thickness is not limited either.

Figure 1:
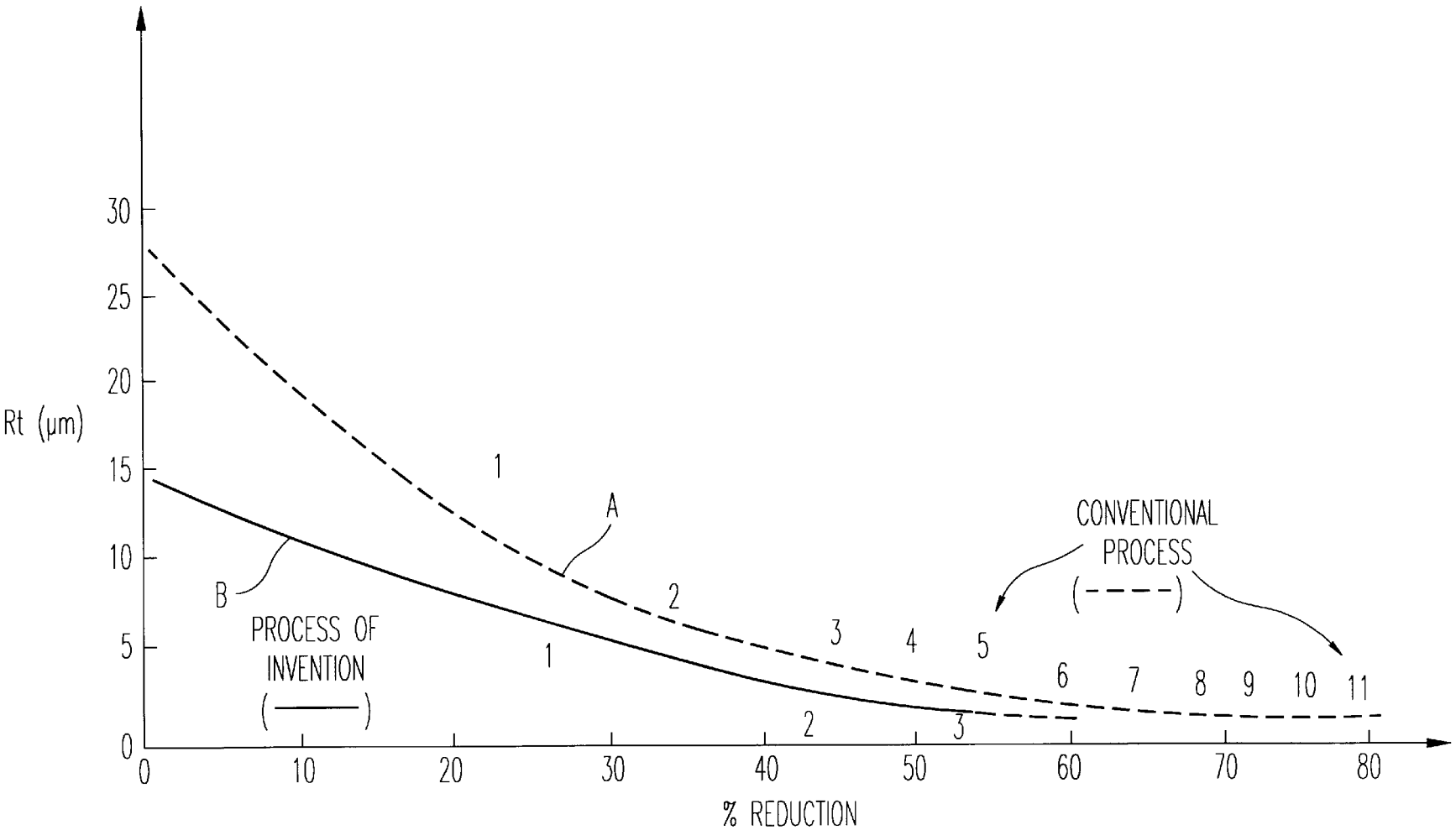
FIG. 1 shows a diagram representing in a cold rolling operation the evolution of the surface state of a sheet strip as concerns roughness, as a function of the number of passes and of the reduction produced by the cold rolling.

In FIG. 1, the curves A and B provide a diagram representing, in a cold rolling operation, the evolution of the surface state of a sheet strip as concerns roughness, as a function of the number of passes and the reduction in thickness. The evolution of the surface state in the conventional process is represented by the curve A and that of the invention by the curve B.

As shown on the curves A and B of FIG. 1, the variation in the roughness of a sheet strip decreases as a function, on one hand, of the reduction of the strip in the course of the cold rolling and, on the other hand, of the number of passes in the cold rolling. The number of passes P is represented on the curves A and B of FIG. 1 by a number within a circle.

The conventional process, in which the sheet strip had been subjected, before the cold rolling, to an annealing followed by a shot blasting and a pickling, permits obtaining a sheet strip having a roughness Rt of 25 to 40 micrometers and an Ra of 2.5 to 4 micrometers. In the process according to the invention, the strip has, before cold rolling, a roughness Rt of 10 to 20 micrometers and an Ra of 1 to 2 micrometers. The strip is moreover completely devoid of oxide.

Preferably, and for the purpose of perfecting the surface state of the stretcher levelled sheet strip, the sheet strip is subjected to an abrasion, for example an abrasive brushing, the brushing being carried out before, after, or during the primary pickling operation.

Also for perfecting the surface state of the sheet strip before the cold rolling operation and the pickling, the sheet strip may be subjected to a shot blasting operation which facilitates the removal of the scale without however disturbing in an excessive manner the surface of the sheet. Indeed, the hot rolled sheet strip which has not been annealed has high mechanical characteristics which, when associated with mild shot blasting conditions, permit a shot blasting without harmful disturbance of the surface of the sheet strip.

While it has been acknowledged that the surface state of a sheet strip was in particular improved when the sheet strip is subjected to a large number of passes in the cold rolling operation, the inventors have discovered that the quality of the surface state of the sheet strip as concerns roughness is due in a large part to the quality of the surface state of the sheet strip before the cold rolling operation. The cold rolling, notwithstanding a large number of passes, removes only very progressively the roughness which appeared in the course of the treatment of the sheet strip before the cold rolling.

According to the invention, the associated stretcher levelling and pickling operations have for their purpose to ensure on the surface of the sheet strip a state of roughness which is such that it permits considerably reducing the number of passes in the cold rolling operation. This is shown by the curve B in FIG. 1. According to the invention, the reduction in the number of passes in the cold rolling imposes rolling conditions which ensure a reduction in the roughness of the sheet strip.

The total reduction in the thickness of the sheet strip is optimized to avoid exceeding a rolling force of 800 tons per meter of width exerted on the rolls of the rolling mills. Beyond this limit, there is formed a thick and rough transfer layer on the working rolls which print onto the rolled sheet strip and impart thereto a high roughness corresponding to an Ra of about 1 micrometer.

The diameter of the rolling mill rolls is less than 180 mm, and preferably less than 150 mm, to permit high reductions in the thickness of the strip with rolling forces lower than 800 tons per meter of width.

Such rolls ensure an improvement in the roughness in the course of the cold rolling. The rolls of the last stand should be polished so as to have very low roughness, preferably lower than 0.1 micrometer.

In order to reach reductions in thickness of the sheet strip of less than 60%, it is preferable to employ paraffinic rolling oils containing one or more friction reducing additives, the additives being preferably one or more esters of which the total concentration in the oil is higher than or equal to 10% by volume. The rolling oils employed permit achieving the aforementioned reductions in a number of passes which is still further reduced, for example two passes, without increasing the rolling forces. For example, the use of a paraffinic oil containing at least 10% ester, permits, for a given rolling force, a reduction in the thickness of the sheet strip of 35% as compared with the reduction of 25% obtained with a conventional oil containing only 1% ester.

Figure 2:
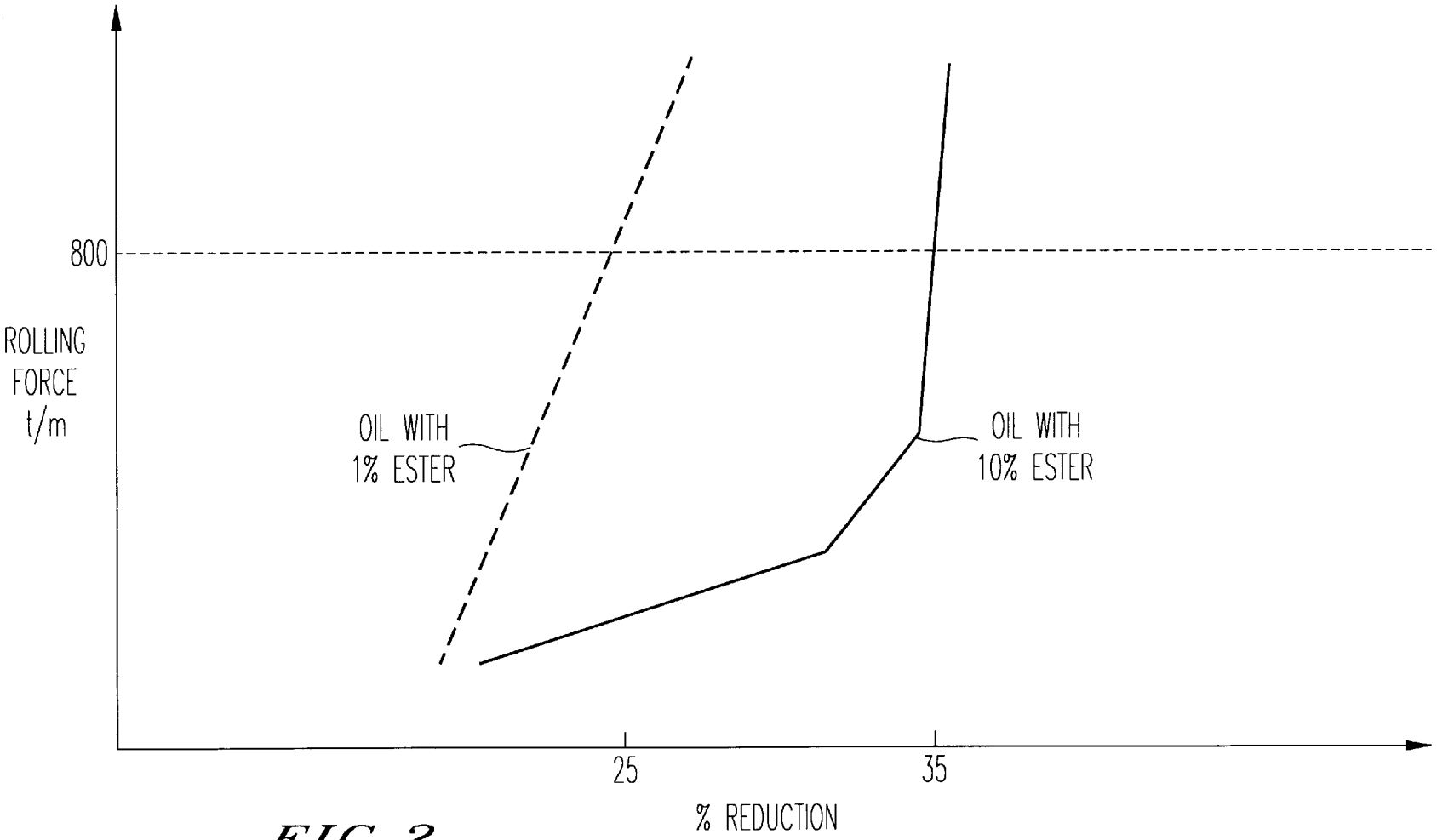
FIG. 2 shows a curve of the rolling forces as a function of the reduction of the cold rolling for two qualities of rolling oil employed.

FIG. 2 shows two curves A and B corresponding to the allowed rolling forces as a function of the different rolling reductions for two ester concentrations of a rolling oil.

In order to perfect the surface state of the stretcher levelled hot rolled sheet strip, said strip may be subjected to a brushing which may be abrasive, the brushing being carried out before, after or during the chemical pickling operation.

For the same purpose, the stretcher levelled hot rolled sheet strip may be, before pickling and/or brushing, subjected to a shot blasting which facilitates the separation of the scale.

The sheet strip produced by the process according to the invention has a surface quality corresponding to a roughness Ra which is lower than 0.25 micrometer and may have a roughness Ra lower than 0.15 micrometer, including lower than 0.1 micrometer.

Figure 3A:
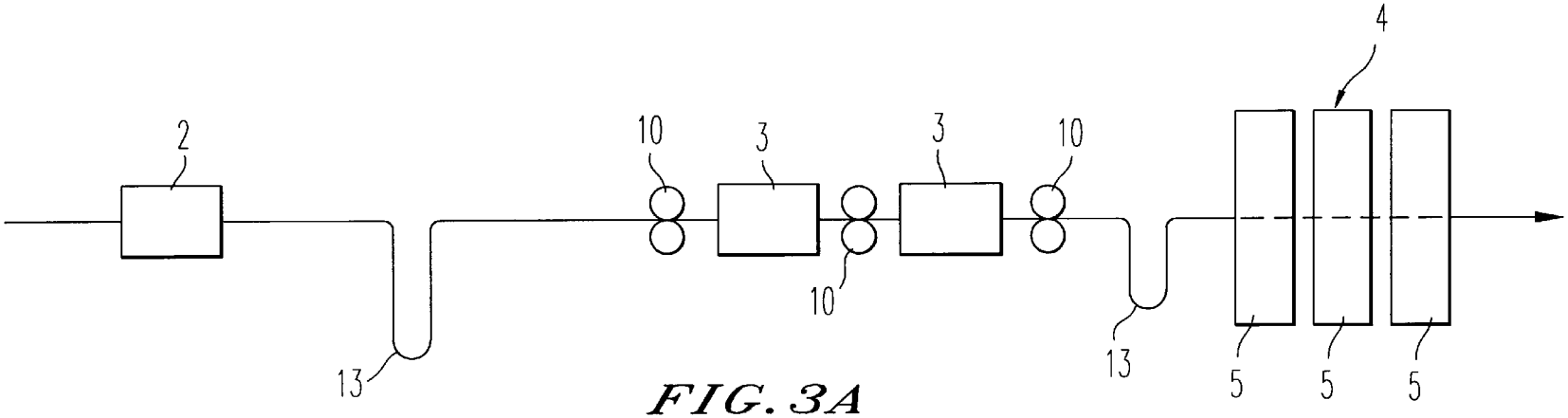
FIG. 3 shows a block diagram of the rolling line according to the invention.
Figure 3B:
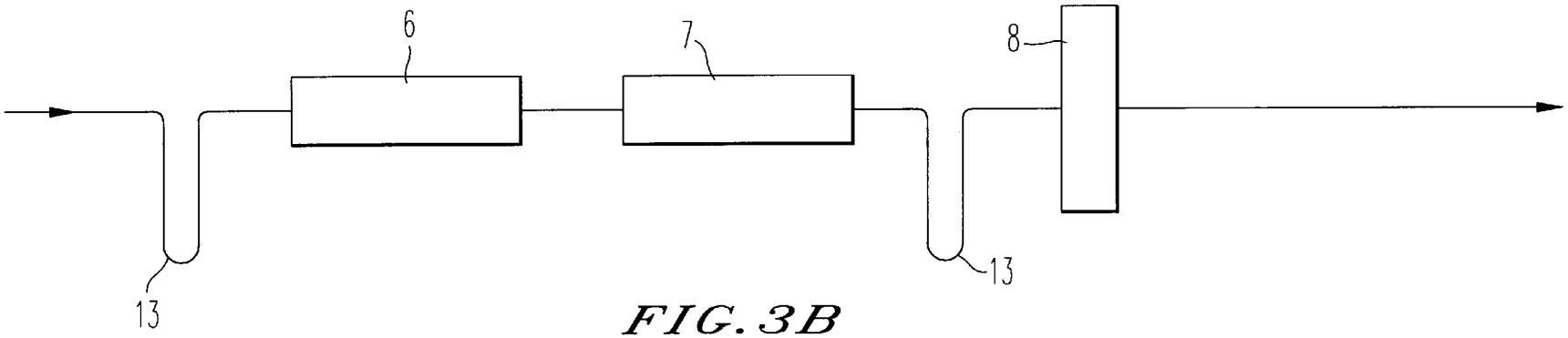

The invention also relates, as shown in FIG. 3, to a production line 1 for carrying out the process, this production line comprising in association a stretcher leveller 2 and a primary pickling station 3 ensuring a stoppage of the pickling operation on the line simultaneously with the stoppage of the cold rolling device.

Further, a very large reduction in the duration of the pickling treatment of the steel is imposed to avoid an accumulation or gathering of the strip between the various devices of the line. Such a continuous production line has the advantage of reducing the intermediate handling and the stocking.

In the field of the cold rolling of stainless steel sheet strips, the treatment of the working rolls of the rolling mill must impart to said rolls a sufficient wear resistance to maintain the quality of their surface during the rolling of at least one coiled strip of 30 tons. The rolls employed are of high-speed steel, supercarburized with vanadium or sintered, and must be changed practically for each rolled coil. Consequently, the line must be stopped in a regular manner for each changing of the working rolls. The use of a pickling bath before the cold rolling device presents the problem of the frequent stoppages of the mill and of the control of the durations of the passage of the strip in the pickling bath. Indeed, the different stoppages of the sheet strip on a single production line requires an arrangement ensuring a reserve supply of strip by means of strip accumulators placed between the various stations and devices.

According to the invention, the primary pickling station 3 is followed by a cold rolling device 4. The pickling station 3 comprises a tank containing an acid bath provided with a device for extracting the immersed sheet strip.

Preferably, and for ensuring the frequent stoppages on the line without deteriorating the strip by an uncontrolled chemical attack, the pickling station 3 is of the spraying type. The station pickling by spraying permits an instantaneous stoppage of the pickling by the stoppage of the spraying simultaneously with the stoppage of the mill.

In another embodiment, the primary pickling station 3 may be an electrolytic pickling station comprising a tank for example of neutral salt, the stoppage of the station being achieved by stopping the electric power supply of the electrolytic tank.

The pickling station 3, provided with means for stopping the pickling, permits reducing in volume or eliminating the strip accumulator 13 usually placed between the pickling station 3 and the cold rolling device 4.

The line 1 comprises, following on the non-reversing cold rolling device 4 having at the most three stands 5, a device 6 for annealing the cold rolled strip, a final pickling station 7, and a cold rolling device of the skin pass type 8. Skin pass cold rolling is well known in the art and is generally characterized by a very low thickness reduction or elongation compared to other cold rolling operations. The effects of skin pass cold rolling including a setting of the mechanical properties of the product (sheet), control of surface roughness as a function of the further use of the product (sheet) and improvement in the flatness of the product (sheet). See "Le livre de l'acier", technique et Documentation Lavoisier, Paris, 1994, incorporated herein by reference, particularly page 1354 thereof.

Figure 4A:
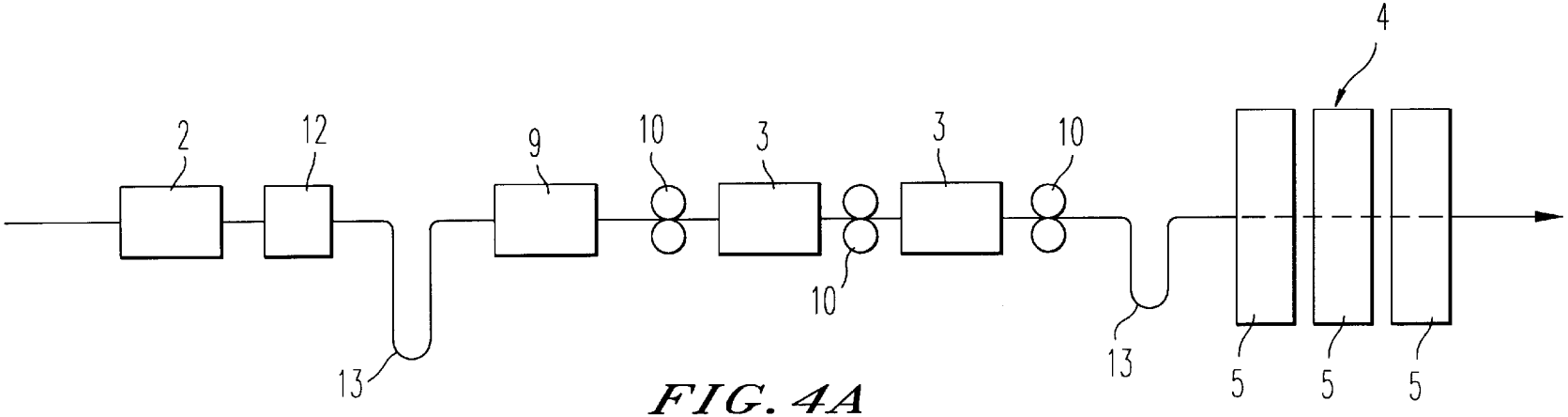
FIG. 4 shows another block diagram of the rolling line according to the invention.
Figure 4B:
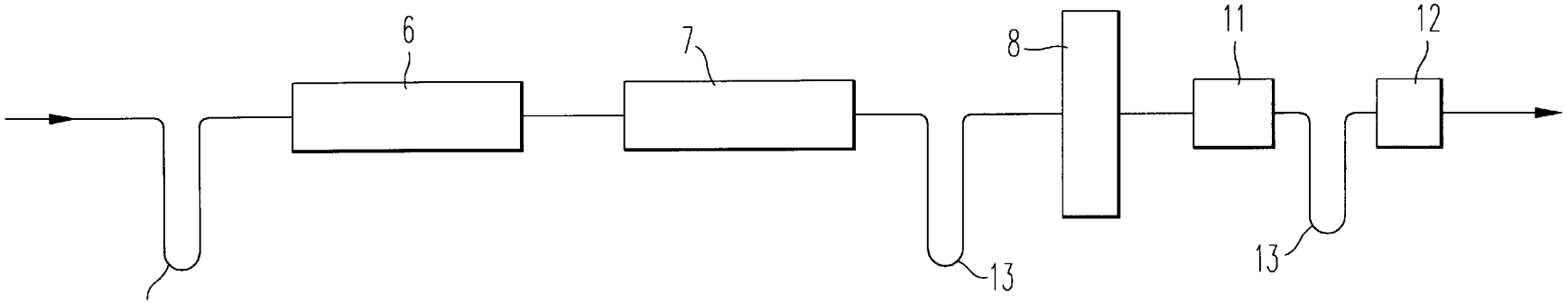

The line 1 according to the invention may further comprise, placed after the stretcher levelling device, as shown in FIG. 4, a shot blasting station 9 and/or brushing means 10 which may be abrasive, contributing to the refining of the quality of the surface of the sheet strip before cold rolling so as to obtain an improved surface state of the sheet strip after said cold rolling, the number of passes of which is reduced.

The production line may further comprise, following on the cold rolling device of the skin pass type, a stretcher leveller device 11 associated with a shearing device 12. A second shearing device may be placed after the stretcher leveller 2.

In one preferred embodiment, a hot rolled austenitic steel sheet strip having a thickness of 2 mm is subjected to a stretcher levelling which produces a residual elongation of 3.5%.

The sheet strip is then pickled in two baths of, e.g., sulphuric acid. At this stage of the process, the sheet strip has a roughness of lower than 1.5 micrometer.

The sheet strip is then subjected to a cold rolling in three passes on a Sendzimir cold rolling train of type ZHi. The sheet strip is cold rolled with a reduction of 50%. The sheet strip is annealed and then pickled. It then has, after these short cold rolling, annealing and pickling operations, a roughness Ra lower than 0.25 micrometer. The sheet strip is subjected, in one pass, to a cold rolling of the skin pass type producing an elongation of 0.8% The sheet strip then has a roughness Ra lower than 0.1 micrometer.

In another preferred embodiment, a hot rolled ferritic steel sheet strip stabilized with titanium and having a thickness of 3 mm is subjected to a stretcher levelling producing a residual elongation of 4%.

The sheet strip is then pickled in an $H_2SO_4$ acid bath, then in an $HN0_3$ acid bath. At this stage of the process the sheet strip has a roughness Ra lower than 2 micrometers.

The sheet strip is then subjected to a cold rolling in two passes with a reduction of 50% on Sendzimir mills of type ZHi, annealed and pickled. It has, after the short cold rolling, annealing and pickling operations, a roughness Ra lower than 0.25 micrometer. The sheet strip is then subjected to a cold rolling operation in one pass of the skin pass type producing an elongation of the strip of 0.8%. The sheet strip then has a roughness lower than 0.15 micrometer.

On this production line, there has been solved the problem of the pickling and in particular of pickling within an imposed short period of time, in order to avoid imperatively an accumulation of the treated strip between the various devices arranged in succession on the continuous strip producing line.

In another preferred embodiment, the stainless steel sheet strip is pickled by an aqueous pickling solution containing hydrochloric acid and ferric and ferrous pickling ions in solution, for a purpose of maintaining a constant pickling power of the aqueous solution of hydrochloric acid and maintaining the concentration of $Fe^{3+}$ions, by reoxidation of the $Fe^{2+}$ions generated in the course of the pickling, the REDOX potential being maintained at a value between 0 and 800 mV, this potential being measured between a platinum electrode and a reference Ag/AgCl electrode placed in the solution.

The pickling operations before rolling in a continuous line ensure an optimum quality of the surface state of the strip. The effectiveness of the pickling may permit, depending on the quality of the sheet strip, the elimination of the mechanical treatments of the stretcher levelling type, shot blasting, brushing, thereby considerably reducing the steel sheet strip production line.

According to the process of the invention, the reduction in the number of passes in the cold rolling step permits providing a continuous line having a reduced cold rolling device, thereby reducing the investment cost for obtaining a sheet of high quality and also greatly reducing the line maintenance and personnel costs. The continuous line thus results in a very considerable reduction in the duration of the treatment, and therefore in the stocks of semi-finished products, and the elimination of intermediate handlings which are the cause of defects and loss of metal.

Obviously, numerous modifications and variations of the present invention are possible in light of the above teachings. It is therefore to be understood that within the scope of the appended claims, the invention may be practiced otherwise than as specifically described herein.

French patent application 95 12271 is incorporated herein by reference.

What is claimed as new and desired to be secured by Letters Patent of the United States is:

1. A process for the continuous production of a rolled stainless steel sheet product, comprising providing a hot produced product and subjecting said product to a treatment comprising at least the following steps:

a stretcher levelling step producing a residual elongation of 1 to 5% primary pickling prior to cold rolling to remove scale and control surface state, cold rolling in at the most three rolling passes, final annealing, final pickling, and skin pass cold rolling.

2. The process according to claim 1, further comprising subjecting said sheet strip to abrasion.

3. The process according to claim 2, comprising effecting said abrasion before said primary pickling operation.

4. The process according to claim 2, comprising effecting said abrasion after said primary pickling operation.

5. The process according to claim 2, comprising effecting said abrasion during said primary pickling operation.

6. The process according to claim 2, comprising effecting said abrasion before and after said primary pickling operation.

7. The process according to claim 2, comprising effecting said abrasion during and after said primary pickling operation.

8. The process according to claim 2, comprising effecting said abrasion with at least one brush.

9. The process according to claim 1, comprising subjecting said sheet strip after said stretcher levelling step to shot blasting for removing scale.

10. The process according to claim 1, wherein said product is a ferritic steel sheet strip, and wherein said cold rolling is effected with a reduction of at most 60%.

11. The process according to claim 1, wherein said product is an austenitic steel sheet strip, and wherein said cold rolling is effected with a reduction of at most 50%.

12. The process according to claim 1, wherein said final annealing is effected in an oxidizing atmosphere at a temperature between 800° and 1200° C.

13. The process according to claim 1, wherein said skin pass cold rolling produces an elongation of said product of between 0.5 and 2%.

14. The process according to claim 1, further comprising subjecting said sheet strip, after said final pickling and said skin pass rolling to stretcher levelling.

15. The process according to claim 1, further comprising subjecting said sheet strip to a shearing operation for cutting edge portions thereof.

16. A production line for producing a rolled stainless steel product having an improved surface state, said production line comprising in succession in combination:

a stretcher leveller, a primary pickling station, a non-reversing device for continuously cold rolling, a device for effecting a final annealing, a device for effecting a final pickling, a skin pass cold rolling device.

17. The line according to claim 16, further comprising a shot blasting station.

18. The line according to claim 16, wherein said primary pickling station comprises means ensuring a stoppage, on said line, of said pickling of said product.

19. The line according to claim 16, wherein said pickling station comprises a tank containing an acid bath and provided with a device for extracting from said bath said product immersed in said bath.

20. The line according to claim 16, wherein said pickling station is a spraying pickling station.

21. The line according to claim 16, wherein said pickling station is electrolytic.

22. The line according to claim 21, wherein said electrolytic pickling station comprises a tank containing an electrolyte selected from the group consists of a neutral salt, phosphoric acid, and a mixture thereof.

23. The line according to claim 6, further comprising abrasion means.

24. The line according to claim 23, wherein said abrasion means is placed before said primary pickling station.

25. The line according to claim 23, wherein said abrasion means is placed after said primary pickling station.

26. The line according to claim 23, wherein said abrasion means is placed in said primary pickling station.

27. The line according to claim 23, wherein abrasion means are placed before and after said primary pickling station.

28. The line according to claim 23, wherein abrasion means are placed before said primary pickling station and in said primary pickling station.

29. The line according to claim 23, wherein said abrasion means is a brush.

30. The line according to claim 16, wherein said cold rolling device comprises at the most three multiroll stands having working rolls of a diameter less than 180 mm.

31. The line according to claim 30, wherein said working rolls have a diameter less than 150 mm.

32. The line according to claim 16, further comprising at least one stretcher levelling station associated with said skin pass cold rolling device.

33. The line according to claim 16, further comprising at least one device for shearing edge portions of said strip.

34. The process as claimed in claim 1, wherein said primary pickling step removes scale and controls surface roughness.

35. The process as claimed in claim 1, wherein said steel sheet product has an Ra lower than 0.25 $\mu$m in the direction of length and in the direction of width.

36. The process as claimed in claim 35, wherein said steel sheet product has an Ra lower than 0.15 $\mu$m in the direction of length and in the direction of width.

37. The process as claimed in claim 35, wherein said steel sheet product has an Ra lower than 0.1 $\mu$m in the direction of length and in the direction of width.

38. The process as claimed in claim 1, consisting essentially of steps which are carried at in the following order.

stretcher levelling, primary pickling, cold rolling, final annealing, final pickling, and skin pass cold rolling.

* * * * *